US006357612B1

(12) United States Patent
Monaco et al.

(10) Patent No.: US 6,357,612 B1
(45) Date of Patent: Mar. 19, 2002

(54) RAIL CAR CUSHIONING DEVICE AND METHOD FOR POSITIONING SAME

(75) Inventors: Jay P. Monaco, Mechanicsburg; Julius I. Perchets, Grantham; Mark P. Scott, Boiling Springs, all of PA (US)

(73) Assignee: ASF-Keystone, Inc.

( * ) Notice: Subject to any disclaimer, the term of this patent is extended or adjusted under 35 U.S.C. 154(b) by 195 days.

(21) Appl. No.: 08/843,014

(22) Filed: Apr. 11, 1997

(51) Int. Cl.[7] ..... B61G 9/16

(52) U.S. Cl. ..... 213/43; 213/45; 213/64; 188/315; 188/322.13

(58) Field of Search ..... 213/10, 41, 43, 213/44, 45, 50, 64, 69; 188/269, 315, 322.13

(56) References Cited

U.S. PATENT DOCUMENTS

| | | | | |
|---|---|---|---|---|
| 1,300,404 | A | 4/1919 | Johnson | |
| 1,689,662 | A | 10/1928 | Bell et al. | |
| 1,951,114 | A | 3/1934 | Wikander | 213/29 |
| 2,184,936 | A | 12/1939 | Clark | 213/46 |
| 2,444,305 | A | 6/1948 | Milhizer | 280/33.9 |
| 2,752,169 | A | 6/1956 | Abel | 280/304 |
| 2,802,580 | A | 8/1957 | Larsson | 213/44 |
| 2,944,681 | A | 7/1960 | Blake | 213/43 |
| 3,040,907 | A | 6/1962 | Pelabon | 213/43 |
| 3,047,162 | A | 7/1962 | Blake | 213/8 |
| RE25,273 | E | 10/1962 | Campbell | 213/44 |
| 3,135,394 | A | 6/1964 | Empson | 213/43 |
| 3,139,989 | A | 7/1964 | Thornhill | 213/223 |
| 3,150,781 | A | 9/1964 | Housman et al. | 213/23 |
| 3,150,782 | A | 9/1964 | Campbell et al. | 213/43 |

(List continued on next page.)

FOREIGN PATENT DOCUMENTS

| | | |
|---|---|---|
| DE | 1455279 | 4/1969 |
| DE | 1947819 | 3/1971 |
| DE | 2161580 | 7/1973 |
| EP | 0417594 A1 | 3/1991 |
| GB | 1038662 | 8/1966 |
| GB | 1218811 | 1/1971 |
| GB | 2027517 A | 2/1980 |

OTHER PUBLICATIONS

"AUTO–BUFF Cushioning Device Description", Jul. 1994.
"AUTO–GARD Cushioning Device Description", Jun. 1995.
"Passive Positioning Cushioning Device Description", 4/96.
"TWIN–GARD Cushioning Device Description", 11/94.
G. Welty, "Thrall's integral–car solution", RAILWAY AGE, Jun., 1995, pp. 53–54.
Thrall Car, "Unlock the Future of vehicle transportation with the UniversalCar.#", RAILWAY AGE, Jun., 1995, pp. 78–79.
Thrall Car, "UniversalCar™ Designed and Built by Thrall Car", 1995.
TTX Engineering and Research Newsletter, vol. 2, No. 2, 2nd Quarter 1995, p. 4.

*Primary Examiner*—S. Joseph Morano
(74) *Attorney, Agent, or Firm*—Edward J. Brosius

(57) ABSTRACT

A self-positioning cushioning device adapted to be mounted in the end of a rail car sill includes a hydraulic cylinder and yoke. A piston rod extends from the cylinder and is joined to one end of a yoke. The other end of the yoke is joined to a rail car coupler through a drawbar. A preloaded stack of elastomer pads is confined in a pocket in the yoke between a pair of stop plates which extend laterally of the yoke to engage stops during movement of the yoke, rod and piston in response to buff and draft impacts. The cylinder is filled with pressurized hydraulic fluid which maintains the piston in a central neutral position with the stop plate adjacent to coupler held against stops on the rail car sill. Buff impacts are cushioned first by the cylinder and at the end of the stroke by both the cylinder and the spring. Draft impacts are cushioned by both the cylinder and the spring.

28 Claims, 5 Drawing Sheets

U.S. PATENT DOCUMENTS

| | | | | | |
|---|---|---|---|---|---|
| 3,160,285 | A | | 12/1964 | Sinclair et al. | 213/43 |
| 3,164,262 | A | | 1/1965 | Price et al. | 213/8 |
| 3,173,552 | A | | 3/1965 | Zanow | 213/43 |
| 3,176,855 | A | | 4/1965 | Mulcahy et al. | 213/43 |
| 3,185,317 | A | | 5/1965 | Willison | 213/44 |
| 3,186,563 | A | | 6/1965 | Empson | 213/43 |
| 3,194,415 | A | | 7/1965 | Rasmussen | 213/43 |
| 3,207,324 | A | | 9/1965 | Blake | 213/8 |
| 3,216,592 | A | | 11/1965 | Peterson et al. | 213/43 |
| 3,217,897 | A | | 11/1965 | Peterson | 213/43 |
| 3,233,747 | A | | 2/1966 | Abbott et al. | 213/7 |
| 3,245,552 | A | | 4/1966 | Natschke | 213/46 |
| 3,249,240 | A | | 5/1966 | Empson | 213/43 |
| 3,251,481 | A | | 5/1966 | Karakashjan et al. | 213/43 |
| 3,265,222 | A | | 8/1966 | Goldman | 213/43 |
| 3,275,164 | A | | 9/1966 | Peterson | 213/43 |
| 3,399,787 | A | | 9/1968 | Zanow | 213/64 |
| 3,400,833 | A | | 9/1968 | Powell | 213/8 |
| RE26,472 | E | | 10/1968 | Peterson | 213/43 |
| 3,406,835 | A | | 10/1968 | Cook | 213/8 |
| 3,411,635 | A | | 11/1968 | Powell | 213/8 |
| 3,446,317 | A | | 5/1969 | Gryglas | 188/88 |
| 3,447,693 | A | | 6/1969 | Cardwell | 213/22 |
| 3,468,433 | A | | 9/1969 | Peterson | 213/43 |
| 3,485,385 | A | | 12/1969 | Smith | 213/43 |
| 3,489,295 | A | | 1/1970 | Hartel | 213/8 |
| 3,493,124 | A | | 2/1970 | Thompson | 213/43 |
| 3,495,719 | A | | 2/1970 | Peppers | 213/43 |
| 3,537,598 | A | | 11/1970 | Moody | 213/8 |
| 3,556,311 | A | | 1/1971 | Kinnecom | 213/8 |
| 3,568,856 | A | | 3/1971 | Knippel | 213/43 |
| 3,589,527 | A | | 6/1971 | Seay et al. | 213/8 |
| 3,589,528 | A | | 6/1971 | Stephenson | 213/43 |
| 3,596,773 | A | | 8/1971 | Peterson | 213/8 |
| 3,596,774 | A | | 8/1971 | MacCurdy | 213/8 |
| 3,598,249 | A | | 8/1971 | Vickerman | 213/8 |
| 3,599,802 | A | * | 8/1971 | Knipple | 213/43 |
| 3,622,015 | A | | 11/1971 | Atkinson et al. | 213/46 |
| 3,630,388 | A | | 12/1971 | Knippel | 213/8 |
| 3,651,953 | A | | 3/1972 | Knippel et al. | 213/43 |
| 3,682,324 | A | | 8/1972 | Hawthorne | 213/8 |
| 3,682,461 | A | | 8/1972 | Wachenheim | 267/31 |
| 3,712,479 | A | | 1/1973 | Atkinson | 213/47 |
| 3,721,351 | A | | 3/1973 | Chierici et al. | 213/8 |
| 3,729,101 | A | | 4/1973 | Brambilla et al. | 213/45 |
| 3,752,329 | A | | 8/1973 | Seay et al. | 213/8 |
| 3,795,390 | A | | 3/1974 | Kendall et al. | 267/33 |
| 3,797,673 | A | | 3/1974 | Daugherty, Jr. | 213/8 |
| 3,800,961 | A | | 4/1974 | Hawthorne | 213/8 |
| 3,806,105 | A | | 4/1974 | Knoishi et al. | 267/116 |
| 3,814,266 | A | | 6/1974 | Hawthorne | 213/8 |
| 3,827,575 | A | | 8/1974 | Mosier et al. | 213/8 |
| 4,002,244 | A | | 1/1977 | Matsumoto et al. | 213/43 |
| 4,136,787 | A | | 1/1979 | Forster et al. | 213/40 R |
| 4,139,182 | A | | 2/1979 | Nagase et al. | 188/284 |
| 4,262,887 | A | | 4/1981 | Jansen | 267/9 A |
| 4,428,565 | A | | 1/1984 | Stiefel et al. | 267/9 A |
| 4,505,458 | A | | 3/1985 | Schultz | 267/9 B |
| 4,838,393 | A | | 6/1989 | Mourray et al. | 188/284 |
| 5,024,301 | A | | 6/1991 | Cook | 188/284 |
| 5,104,101 | A | | 4/1992 | Anderson et al. | 267/219 |
| 5,265,710 | A | | 11/1993 | Gabas et al. | 267/226 |
| 5,415,303 | A | * | 5/1995 | Hodges et al. | 213/43 |
| 5,487,480 | A | * | 1/1996 | Page et al. | 213/43 |
| 5,642,823 | A | * | 7/1997 | Kalina et al. | 213/43 |
| 5,676,265 | A | * | 10/1997 | Miller | 213/43 |
| 5,746,335 | A | | 5/1998 | Brough et al. | 213/43 |
| 5,996,978 | A | | 12/1999 | Asanuma et al. | 267/35 |

* cited by examiner

RAIL CAR CUSHIONING DEVICE AND METHOD FOR POSITIONING SAME

FIELD OF THE INVENTION

The invention relates to cushioning devices mounted on the ends of rail cars to cushion buff and draft impacts exerted on the couplers by an adjacent rail car.

DESCRIPTION OF THE PRIOR ART

Cushioning units are conventionally mounted in pockets at the ends of the center sill of a rail car. The rail cars are joined together to form a train by pairs of knuckle couplers connected to the cushioning units. The train may be 50 or more cars long and drawn by one or more locomotives. The pairs of knuckle couplers provide approximately 2 inches of free movement or slack between adjacent cars. This slack permits the rail cars limited movement toward and away from each other in response to train action events including locomotive traction and braking, differences in braking forces of adjacent cars and gravity-induced movement of the cars as the train moves onto and away from inclines.

Train action events subject the couplers of joined cars to buff and draft impacts which, if undamped, are transmitted directly to the rail cars and subject the cars and lading to undesirable high accelerations. The accelerations can injure lading on the rail cars.

In some train action events, including locomotive start up and acceleration, traction braking and movement of the train onto and from inclines, slack is taken up between adjacent cars beginning at one end of the train and ending at the other end of the train. As a result of slack being progressively taken up the speed differences between the cars as the slack at each coupler pair is taken up increases, with a resultant increase in the buff and draft impacts on the couplers. For instance, during locomotive acceleration of a 50 car train from rest there is a total of 100 inches of slack between the 50 pairs of couplers in the train. This slack is taken up progressively, coupler pair by coupler pair. When the 2 inch slack in the coupler pair joining the last car to the train is taken up the next to the last car may be moving to a speed of 4 miles an hour. The slack in the last coupler pair is taken up very rapidly and the last two cars are subjected to a very large impact capable of injuring lading.

Trains are made up in rail yards, conventionally by rolling individual cars into stationary cars so that the knuckle couplers are engaged. Relative high speed rolling of cars against stationary cars subjects both cars to high buff impacts which are capable of injuring lading on the cars.

Conventional end of car rail car cushioning units do not efficiently cushion impacts from train action events, both in buff and draft, and do not efficiently cushion high buff impacts experienced during train make-up.

SUMMARY OF THE INVENTION

The invention is an improved end of car rail car cushioning device for cushioning train action buff and draft impacts and for cushioning buff impacts during train makeup. The unit is self-centering after both buff and draft impacts and includes a gas charged hydraulic cylinder and an elastomer spring mounted between the rail car and a coupler at the end of the car. The piston in the cylinder is normally located in a neutral position between the front and rear heads of the cylinder and is moveable in either direction in response to buff and draft impact movement of the coupler to displace hydraulic fluid from the cylinder and hydraulically cushion buff and draft impacts.

During buff impacts, the elastomer spring is free of the coupler as the cylinder moves along a long buff stroke and absorbs energy. During the final 2 inches of buff stroke, the elastomer spring is joined to the coupler in parallel with the hydraulic cylinder and both the cylinder and the spring absorb energy. The elastomer spring prevents the unit from bottoming and protects the lading from high accelerations.

During draft impacts the cylinder and spring are joined to the coupler in parallel and both absorb impact energy along a short 2 inch draft stroke. The spring prevents bottoming and protects lading from high accelerations.

The elastomer spring has a collapse stroke of approximately 2 inches, and nonlinear characteristics with a very high spring rate near the end of its stroke, which assures that nearly all impacts, both in buff and draft, are fully absorbed before the cushioning device bottoms and impact force is transmitted directly to the rail car. The long buff stroke facilitates hydraulic absorption of high energy buff impacts during train make up.

Spring backed valves are mounted in flow orifices in the hydraulic cylinder to either side of the neutral position. These valves crack open only after a buff or draft force exerted on the coupler exceeds a minimum force. The high coupler forces required to crack open the spring backed valves assures that the cushioning unit holds the coupler in place when subjected to low energy buff and draft impacts which do not injure lading, yet collapses and absorbs energy when high force impacts are experienced, in both buff and draft. The ability to keep the cushioning unit stiff during low level impacts reduces movement between adjacent rail cars and helps reduce impact injury to lading.

Other objects and features of the invention will become apparent as the description proceeds, especially when taken in conjunction with the accompanying drawings illustrating the invention, of which there are five sheets and one embodiment.

DESCRIPTION OF THE PREFERRED EMBODIMENT

Figure 1:
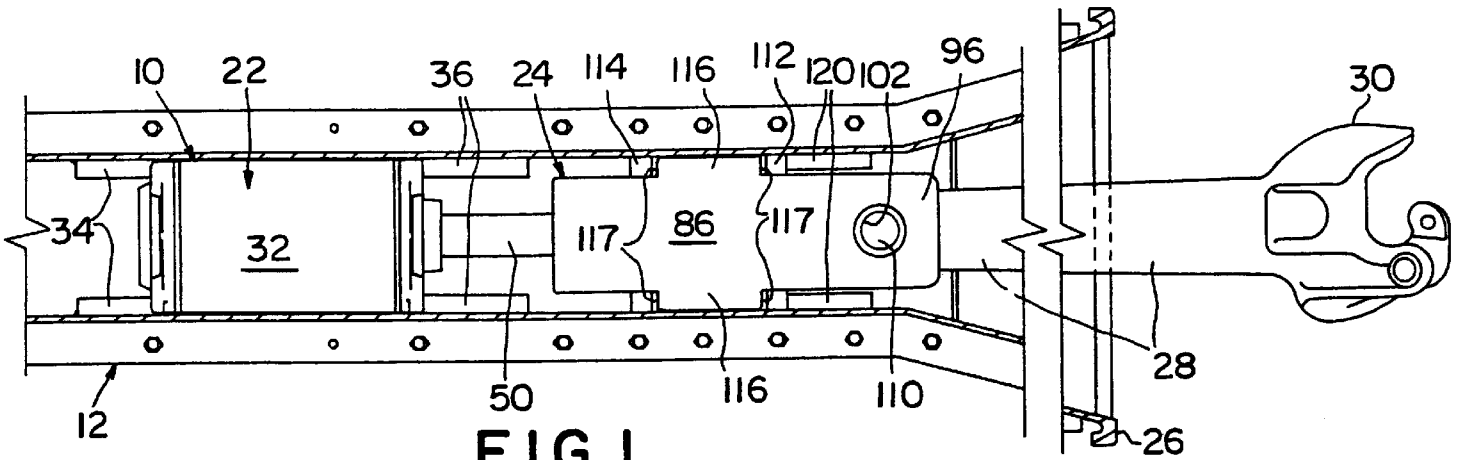
FIGS. 1 and 2 are horizontal and vertical sectional views, respectively, illustrating a cushioning device mounted in the end of the sill of a rail car in the neutral position.

Self-positioning rail car cushioning unit 10 is mounted in one end of rail car center sill 12. The sill has a rectangular cross section with opposed side walls 14 and top wall 16. Bottom support plates 18 are secured to flanges at the lower ends of side walls 14 to hold unit 10 in place. The outer end of the sill is flared to permit swinging of drawbar 28.

Unit 10 includes a gas charged hydraulic cylinder 22 and an elastomer spring yoke assembly 24. The hydraulic cylinder is located in the pocket 20 away from the enlarged open end 26 of the sill and the yoke assembly is located between the cylinder and end 26. Drawbar 28 is connected to the yoke assembly and extends outwardly from the sill to knuckle coupler 30.

Cylinder 22 includes a cylindrical body 32 which is held in place in the inner portion of the pocket between opposed pairs of opposed stop blocks 34 and 36 secured on the inside of sill side walls 14. The blocks 34 and 36 hold the cylinder body against movement along the sill.

Figure 8:
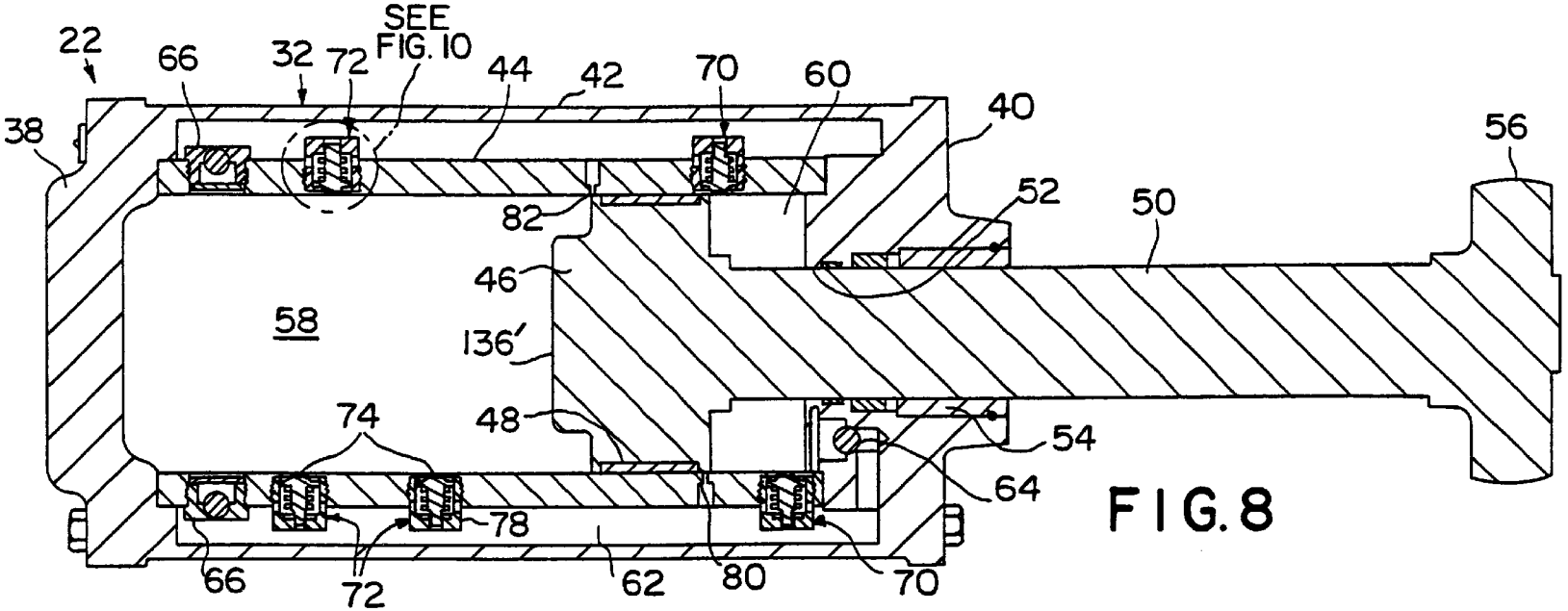
FIG. 8 is a sectional view taken through a gas charged hydraulic cylinder used in the cushioning unit.

As illustrated in FIG. 8, cylinder 22 includes rear head 38, front head 40, exterior cylinder 42 extending between the heads and inner piston cylinder 44 also extending between the heads. Piston 46 is fitted within cylinder 44 and is provided with sealing and bearing rings 48 engaging the interior wall of cylinder 44. In FIG. 8, the piston is in a neutral position between heads 38 and 40. Piston rod 50 is joined to piston 46 and extends outwardly of body 32 through opening 52 in front head. 40 toward the yoke assembly. High pressure seals 54 are provided in opening 52. An enlarged mounting element or head 56 is provided on the free end of rod 50.

Piston 46 divides the space within piston cylinder 44 into a cylindrical buff chamber 58 located between the piston and the rear head and an annular draft chamber 60 surrounding piston rod 50 and between the piston and the front head 40. Annular chamber or reservoir 62 is located between cylinders 42 and 44 and extends between heads 38 and 40.

The interior chambers in hydraulic cylinder 22 are charged with a fluid mixture of hydraulic oil and high pressure nitrogen gas. Sufficient hydraulic oil is charged into the cylinder to completely fill chambers 58 and 60 with oil with separated nitrogen gas filling the top of reservoir 62. In practice, buff or draft movement of the piston in the cylinder mixes the nitrogen with the hydraulic oil to form a froth that fills the interior chambers. The nitrogen is preferably charged at a pressure of 500 p.s.i.

Figure 10:
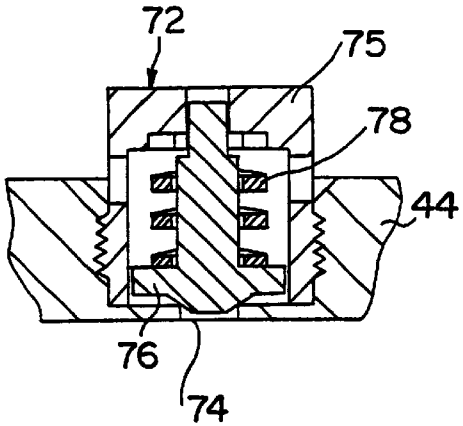
FIG. 10 is an enlarged view of portion 10 of FIG. 8.
Figure 9:
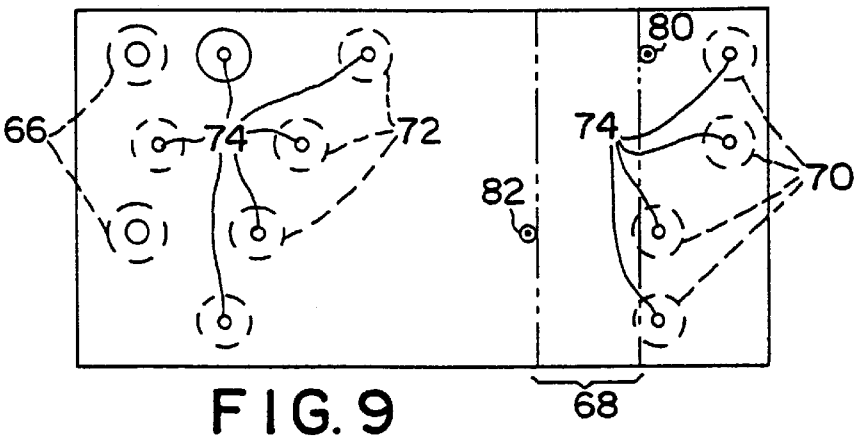
FIG. 9 is a view of the unrolled interior wall of the piston cylinder used in the cylinder illustrated in FIG. 8.

Movement of the piston and rod in body 32 flows the hydraulic fluid between the various chambers through a number of valves illustrated in FIGS. 8, 9 and 10. A plurality of large area one way check valves, like valve 64 shown in FIG. 8, are provided in front head 40 surrounding opening 52. Each check valve 64 includes a ball valve member located in a passage communicating reservoir 62 and draft chamber 60. The check valves permit free flow of hydraulic fluid from the reservoir 62 into the draft chamber during movement of the piston 46 toward rear head 38. During movement of the piston toward the front head 40 the valves close to prevent flow of hydraulic fluid through the passages from the draft chamber into the reservoir.

A number of large area one way check valves 66 are mounted in the end of piston cylinder 44 adjacent rear head 38 and communicate reservoir 62 and buff chamber 58. These valves permit free flow of hydraulic fluid from the reservoir into the buff chamber during movement of the piston toward the front head 40 but prevent flow of hydraulic fluid out of the buff chamber 58 during movement of the piston toward the rear head 38. Valves 64 could be located in the adjacent end of cylinder 44. Valves 66 could be located in head 38.

In FIG. 8, piston 46 is shown in a neutral position located slightly more than 2 inches from the front head and slightly more than 10 inches from the rear head. The piston moves toward the front head along a draft stroke of 2 inches without engaging the front head and moves toward the rear head during a buff stroke of 10 inches without engaging the rear head. When in the neutral position, the sealing and bearing rings 48 on piston 46 engage a cylindrical band 68 on the interior surface of piston cylinder 44, shown in FIG. 9.

A number of spring backed flow control valves are mounted in bores extending through cylinder 44 and communicate the reservoir 62 with the interior of the cylinder. Sets of like spring backed check valves 70, 72 are located to either side of band 68. A set of spring backed valves 70 is located in the cylinder between band 68 and the front head 40. A set of spring backed valves 72 is located in the cylinder between the band 68 and rear head 38. During buff movement of piston 46 from the neutral position toward rear head 38 the rings 48 pass over and close valves 72. The rings, however, do not close one way valves 66. During draft movement of piston 46 toward head 40 rings 48 pass over and close valves 70.

Each spring backed check valve 70, 72 is fitted in a large diameter bore extending into the outside of cylinder 44 surrounding a smaller flow orifice 74 formed in the inner wall of cylinder 44. A spring backed moveable valve member 76 is confined within body 75 and is biased by spring 78 toward the orifice to normally close the orifice. A pair of bleed apertures 80 and 82 extend through cylinder 44 to either side of band 68. Aperture 80 is immediately adjacent the side of the piston facing front head 40 and aperture 82 is immediately adjacent the side of the piston facing rear head 38.

Elastomer spring yoke assembly 24 includes a metal yoke or body 84 with spaced apart top and bottom straps 86 and 88 joined by front and rear vertical walls 90 and 92 to define an elastomer spring pocket 94 located in the body and extending between the sill side walls 14. The straps project forward wall 90 to form front strap ends 96 and 98 located above and below socket 100 in the exterior face of wall 90. Pin bores 102 extend through front strap ends 96 and 98. The top and bottom straps also extend rearwardly beyond rear wall 92 to form hooked rear ends or mounting members 104 and 106. Piston rod head 56 is fitted in a recess 108 located between the hook ends 104 and 106 and rear wall 92 so that the yoke assembly 24, piston rod 15 and piston 46 are joined and moved back and forth together along sill 12.

Figure 2:
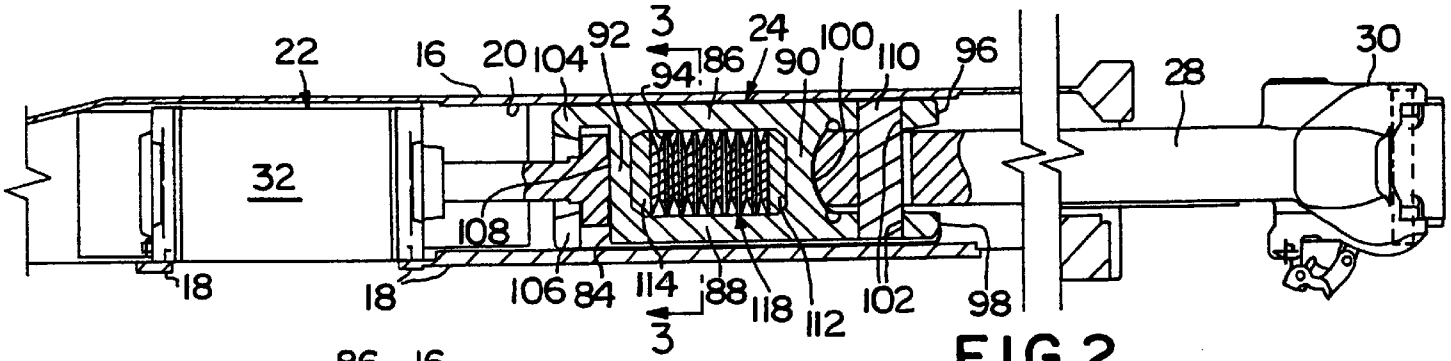

Drawbar 28 is secured to body 84 by vertical pin 110 which extends through bores 102 and a passage in the butt end of the drawbar. As illustrated in FIG. 2, the butt of the drawbar is seated in socket 100.

Figure 3:
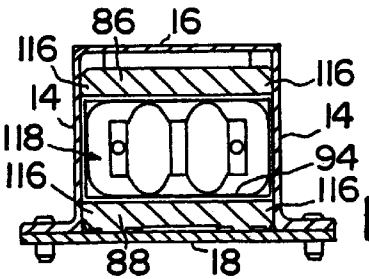
FIG. 3 is a sectional view taken along line 3—3 of FIG. 2.
Figure 4:
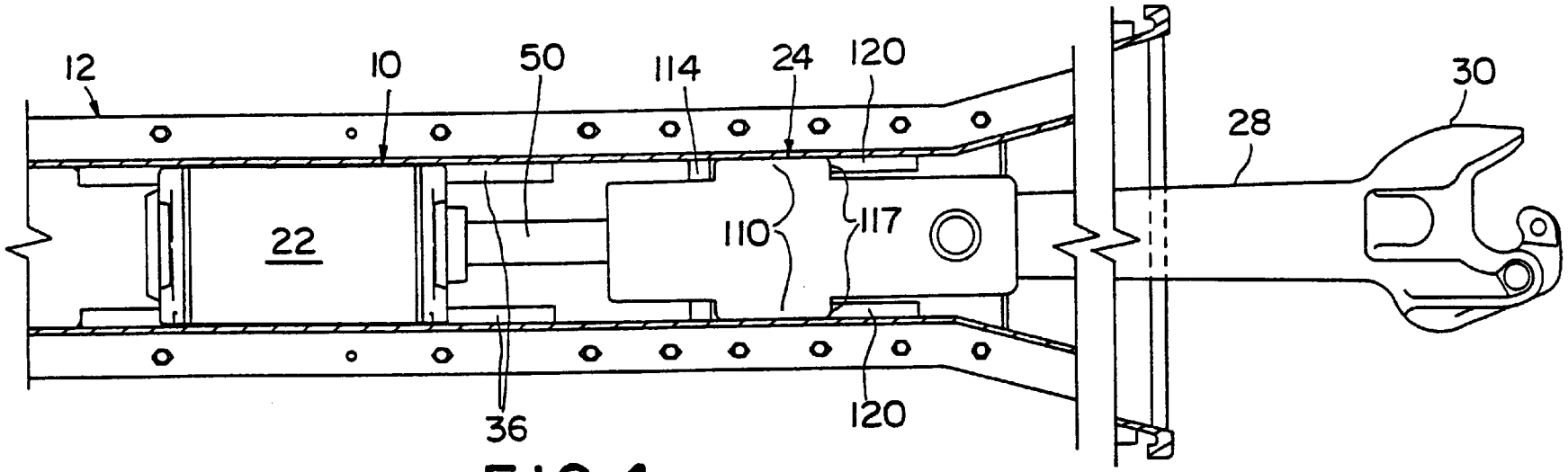
FIGS. 4 and 5 are similar to FIGS. 1 and 2 showing the cushioning unit in a full draft position.
Figure 5:
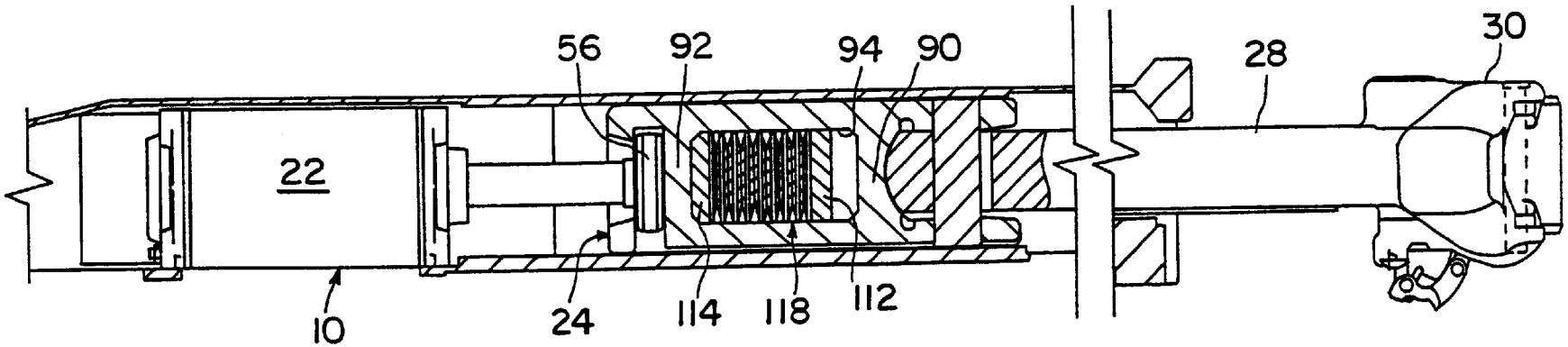
Figure 6:
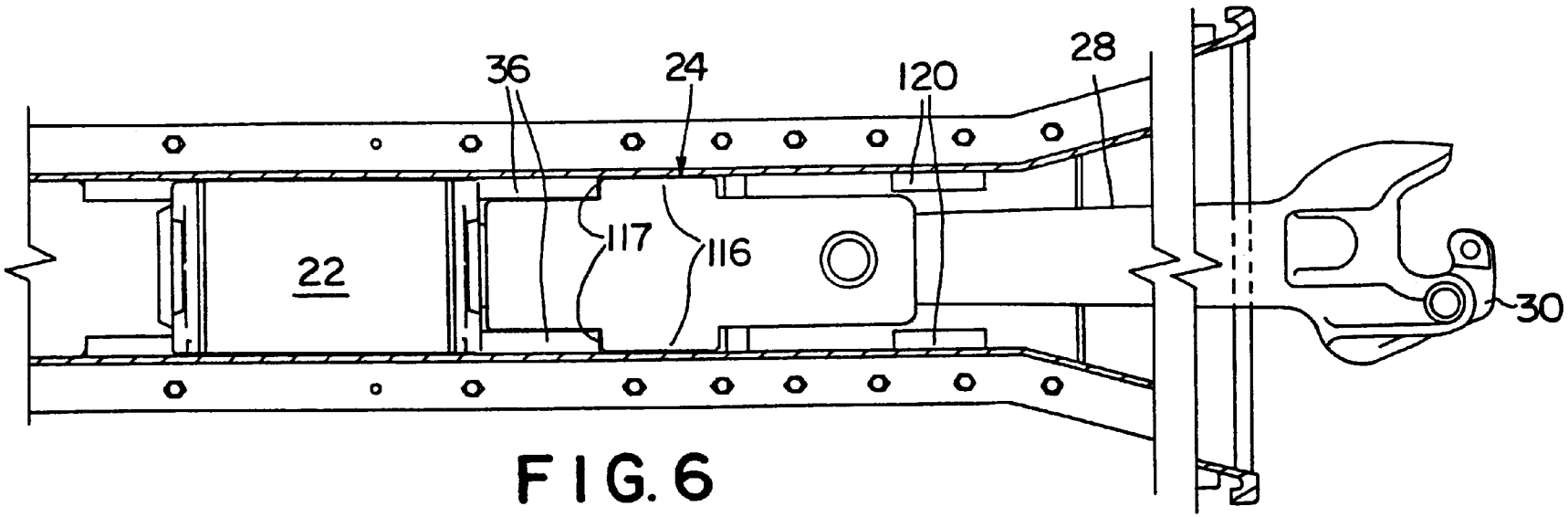
FIGS. 6 and 7 are similar to FIGS. 1 and 2 showing the cushioning unit in a full buff position.
Figure 7:
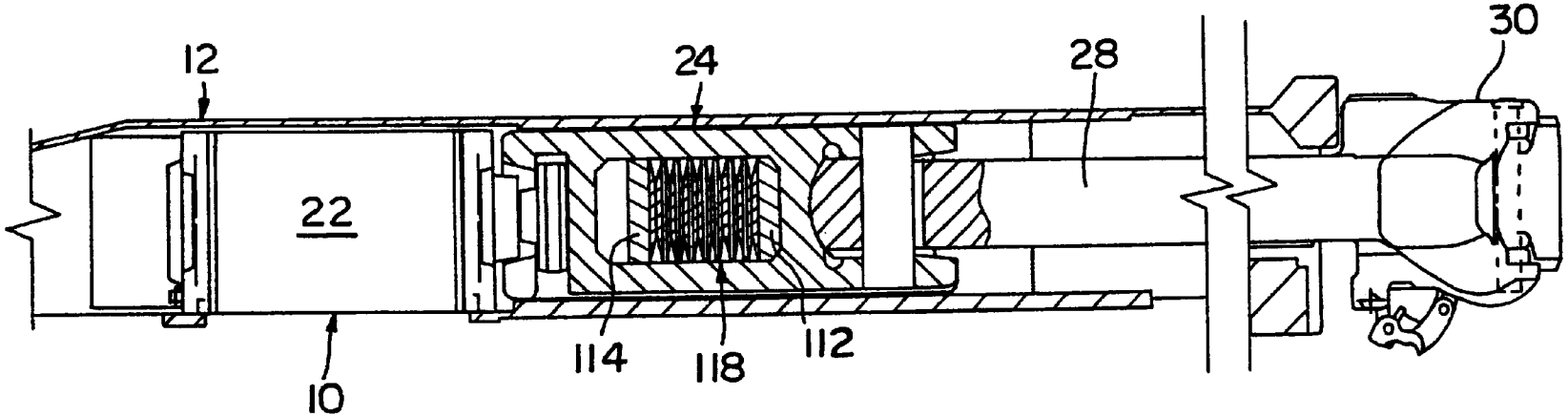

Front and rear stop plates 112 and 114 are fitted in the front and rear ends of pocket 94 and normally engage front wall 90 and rear wall 92, respectively. As illustrated in FIG. 1, the ends of plates 112 and 114 extend laterally to either side of body 84. The body includes centrally located top and bottom lateral ears 116 shown in FIGS. 1 and 3. Forward and rear contact surfaces 117 on the sides of the ears are normally located inwardly from the walls 90 and 92.

An elastomer spring 118 is compressed and fitted in pocket 94 between plates 112 and 114. Spring 118 is located on and acts along the longitudinal axis of piston rod 50. The spring includes a stack of flat, resilient elastomer pads formed from styrene-butadiene rubber of the type marked under the trademark KEY-GARD by Keystone Industries, Inc. assignee of the present application. The elastomer spring 118 is preloaded. When in the neutral position, the elastomer spring has a 15,000 pound compression force holding the plates 112 and 114 against walls 90 and 92.

When device 10 is in the neutral position shown in FIGS. 1 and 2, the outer ends of plate 112 are held against a pair of vertical stop blocks 120 mounted on sill inner walls 14 adjacent the outer end of the sill. In this position, the adjacent contact surfaces 117 of ears 116 are located 2 inches from blocks 120 and the adjacent contact surfaces of ears 116 are located 10 inches from blocks 36.

Unit 10 is held in the neutral position by the pressure of the hydraulic fluid acting on the large area front face of the piston. The pressurized fluid exerts a force of 5,000 pounds biasing the piston toward the end of the sill. This force holds the yoke assembly in the neutral position with the ends of plate 112 engaging draft stop blocks 120. The 5,000 pound gas pressure force exerted on the piston is less than the 15,000 pound preload compression force of the elastomer spring 118 and does not compress the elastomer spring.

From the neutral position cushioning unit 10 has a maximum buff stroke of 10 inches from the neutral position before ears 116 engage buff stop blocks 36 and a maximum draft stroke of 2 inches before the ears engage stop blocks 120. Piston 46 is directly connected to coupler 30 through the piston rod 50, yoke assembly body 84 and drawbar 28 and moves with the coupler during buff and draft strokes. At the end of the full 10 inch buff stroke the piston is adjacent rear head 38 and partially covers the flow passages in check valves 66.

Figure 11:
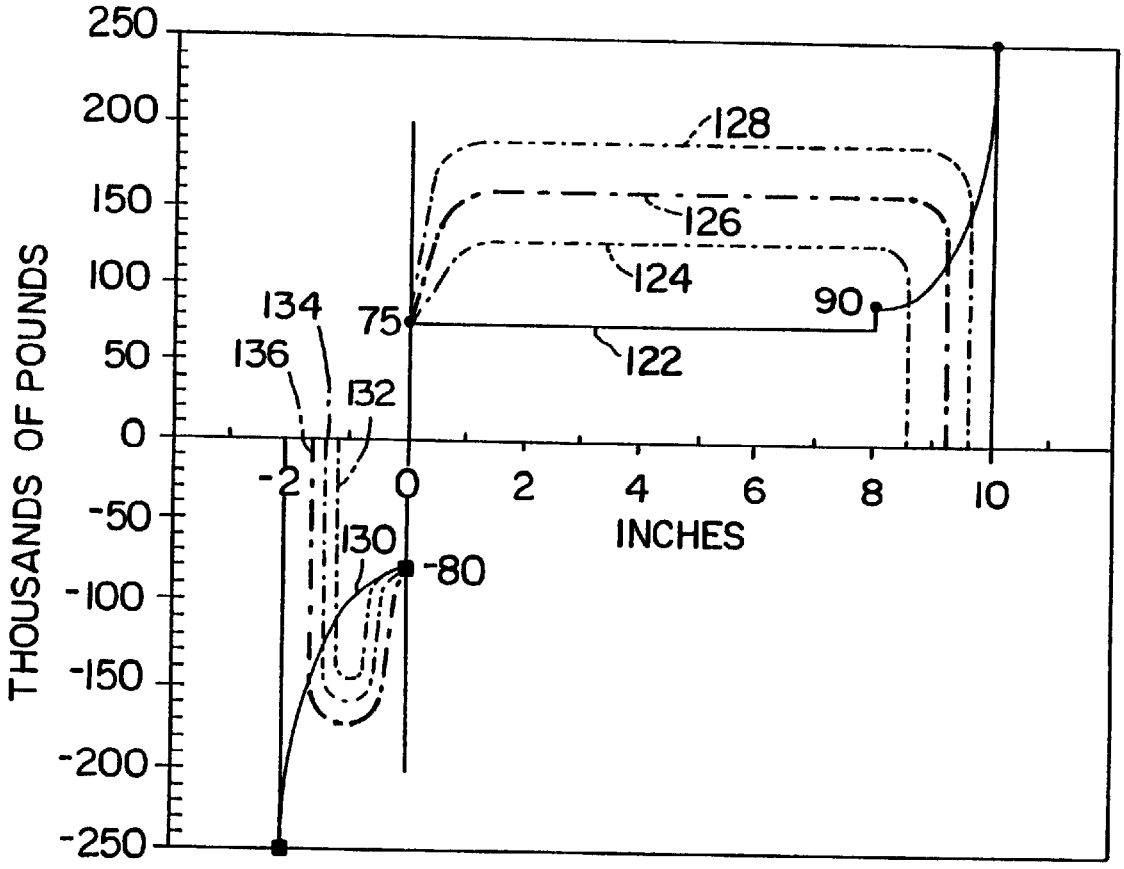
FIG. 11 is a graph illustrating compression forces for the unit, both in buff and draft.

The FIG. 11 illustrates buff and draft performance of unit 10 as presently understood and shows static and total compression forces generated by unit 10 in both buff and draft directions. Total compression forces are shown for different energy impacts. The horizontal axis represents the position of the coupler away from the neutral position of FIGS. 1 and 2 during buff and draft strokes. The unit has a maximum 2 inch stroke to the left in draft and a maximum 10 inch stroke to the right in buff. The vertical axis of the FIG. 11 graph represents the reaction or compression force of the unit in thousands of pounds. The upper right hand portion of the graph represents performance of the unit in buff and the lower left hand portion represents performance of the unit in draft.

Curve 122 represents the static compression force curve for unit 10 as the unit is moved from the neutral position along the 10 inch buff stroke. During the first 8 inches of stroke from the neutral position the static compression force is 75,000 pounds. The static force is the total of a 70,000 pound force resisting movement of piston 46 toward rear head 38 required to pressurize the hydraulic fluid in chamber 58 sufficiently to crack valves 72 open and allow hydraulic fluid to flow out from the chamber 58, and a 5,000 pound force exerted on the face 136, of the piston 46 by the pressurized hydraulic fluid in cylinder 22. The 5,000 pound force and the 70,000 pound force are essentially constant throughout the buff stroke. If the buff impact force exerted on the coupler is below or falls below 75,000 pounds, valves 72 close and buff motion of unit 10 stops.

During initial 8 inches of buff stroke, elastomer spring 118 is moved inwardly with the yoke assembly 24 but is not compressed. At 8 inches of stroke, plate 114 engages stops 36 to join the elastomer spring to the hydraulic cylinder 22 so that during the final two inches of buff stroke the elastomer spring and hydraulic spring are coupled together in parallel and the static compression force for unit 10 is the sum of the compression forces for the hydraulic cylinder and the elastomer spring.

The elastomer spring is preloaded in pocket 94 and exerts a 15,000 pound force holding plates 112 and 114 against walls 90 and 92. When the unit 10 has been moved 8 inches from the neutral position along the buff stroke the static compression force is increased from 75,000 pounds to 90,000 pounds because of the elastomer spring preload. This increase is represented by the vertical step in curve 122 at the 8 inch position. During the final 2 inches of movement along the buff stroke the static compression force for unit 10 is the sum of the static compression force for cylinder 22 and the compression force for the elastomer spring. This force increases very rapidly to 250,000 pounds at a full 10 inch stroke.

The curves 124, 126 and 128 illustrate the total compression force for unit 10 as the unit is moved from the neutral position along the buff stroke in response to buff impacts exerted on coupler 30. Curve 124 illustrates a relatively low energy buff impact. The curves 126 and 128 represent higher energy buff impacts. The difference between curve 122 and each of curves 124, 126 and 128 represents the hydraulic compression force for the impacts generating curves 124, 126 and 128.

When coupler 30 is impacted in a buff direction the resultant force is transmitted to the yoke body and piston. Cushioning unit 10 does not move along the buff stroke until the coupler force exceeds the 75,000 pounds static force required to open valves 72 and permit hydraulic fluid to flow from chamber 58. When the coupler force exceeds 75,000 pounds the cracking pressure for valves 72 is exceeded, the valves open and the piston moves toward the rear head. The extent to which the valves are opened depends upon the energy of the impact. Low energy impacts, as represented by curve 124, open the valves partially to permit relatively low speed movement of the piston toward the rear head. High energy impacts, as represented by curve 128, fully open the valves and permit the piston to move more rapidly toward the rear head. The hydraulic compression force resulting from flowing hydraulic fluid out through open valves 72 depends upon the open area of flow orifices 74. The maximum orifice areas for valves 72 and the placement of the valves along the length of cylinder 44 are chosen to maintain an essentially constant hydraulic compression force along the buff stroke, as indicated by the flat portions of the curves 124–128. In practice, these portions of the curves may be somewhat irregular due to changes in the cross sectional area available for flowing hydraulic fluid out of chamber 58 as the piston 46 passes over and closes valves and due to the 15,000 pounds compression force increase at 8 inches of stroke. The relatively high, uniform hydraulic compression force for unit 10 assures impact energy is efficiently absorbed during the buff stroke and motion of the coupler in the buff direction is smoothly and safely slowed to protect lading from high inertia accelerations. During the buff stroke hydraulic fluid is flowed from chamber 58 into chamber 62 through valves 72 and from chamber 62 into chamber 60 through valves 64.

Curve 124 illustrates that unit 10 exerts an essentially uniform compression force of 135,000 pounds along the buff stroke until motion of the coupler in a buff direction slows at about 7 inches of stroke to reduce the hydraulic compression force so that the total compression force rapidly decreases to the static compression force of 75,000 pounds. When this occurs, the remaining open valves 72 in front of piston 46 close and buff movement of the piston, yoke assembly and coupler stops.

After buff movement stops, the 5,000 pound gas pressure force on the front face of piston 46 slowly returns the piston, yoke assembly and coupler to the neutral position. At this time check valves 66 open to permit hydraulic fluid to flow from reservoir 62 into chamber 58. Spring backed valves 70 and 72 and check valves 64 are closed. Hydraulic fluid in draft chamber 60 is pressurized and flows out from the chamber through both bleed apertures 80 and 82 and then bleed aperture 80 only. The pressure of the hydraulic fluid continues to move the piston toward the neutral position shown in FIG. 8 until plate 112 contacts stop blocks 120. In this position, bleed aperture 80 is located closely adjacent to the end of the sealing ring 48 adjacent front head 40.

Curve 126 is similar in shape to curve 124 and shows the total compression force for unit 10 when subjected to a higher energy buff impact than the impact for curve 124. The higher energy impact of curve 124 results in a constant level total compression force of about 155,000 pounds through a stroke greater than 8 inches. The total compression force increases by 15,000 pounds when the stroke exceeds 8 inches, due to coupling of the elastomer spring to the hydraulic spring. As impact energy is absorbed by unit 10 the buff motion of the coupler slows and the hydraulic compression force exerted by cylinder 22 is reduced until the total compression force falls to about 120,000 pounds where curve 126 intersects the static compression force curve 122. At this point, all impact energy has been absorbed, and buff movement of the coupler along the buff stroke stops. The unit then returns to the neutral position as previously described and spring 118 expands to the position of FIG. 1.

Curve 128 illustrates the total compression force for a relatively high energy buff impact. The energy imparted by this impact is absorbed by unit 10 as described in connection with the lower level energy impact of curve 126.

Curves 132, 134 and 136 illustrate the total compression force for unit 10 in response to the successively higher energy draft impacts exerted on coupler 30. A draft impact exerted on coupler 30 sufficient to move the coupler in a draft direction must be greater than 80,000 pounds. This figure represents the total of a 70,000 pound force required to pressurize hydraulic fluid in draft chamber 60 sufficiently to crack open valves 70, plus the 15,000 pound preload of elastomer spring 118, less the 5,000 pound gas preload exerted on the front face of the piston 46 and biasing the piston in the draft direction.

If the draft impact force is greater than 80,000 pounds then valves 70 open and the coupler, yoke assembly, and piston are moved in the draft direction along the draft stroke. The extent to which the valves open depends upon the impact energy, as previously described. Curves 132, 134 and 136 shown in FIG. 11 illustrate the total compression force of unit 10 resisting draft movement of coupler 30 for different energy impacts. This force is the total of the compression force of elastomer spring curve 130, and the hydraulic compression force resulting from high speed flow of hydraulic fluid through open valves 70 less the 5,000 pound gas preload. As illustrated, the total compression force of unit 10 increases rapidly from the 80,000 pound cracking pressure to a peak. As draft movement of the coupler slows, the hydraulic force decreases and the total force falls to intersect curve 130. At the intersection points of curves 132, 134 and 136 with curve 130 the draft movement of the coupler is stopped and the total compression force falls to zero. Spring 118 then expands to return the coupler, yoke assembly and piston 46 back to the neutral position. During return of the piston to the neutral position hydraulic fluid flows out of chamber 58 through the bleed aperture 82. When spring 118 is fully expanded the pressure of the hydraulic fluid on piston 46 holds plate 112 against wall 90 and the piston is returned to the neutral position.

Curves 124, 126, 128 and 132, 134 and 136 represent the compression forces exerted by unit 10 in absorbing buff impacts resulting from train make up, and buff and draft impacts resulting from train action events. Higher energy impacts would result in more rapid movement of piston 46 away from the neutral position, more rapid flow of hydraulic fluid out through the spring backed valves and corresponding higher hydraulic compression forces required to absorb higher impact energies. Unit 10 is self-centering and returns to the neutral position after impact energy has been absorbed.

Buff and draft impacts on coupler 30 during normal operation have a total energy insufficient to fully collapse the unit 10 in buff or draft. Very high energy impacts may fully collapse the unit in buff or draft, leaving residual unabsorbed energy. The residual energy is dissipated by bottoming contact with stop blocks 36 and 120. While residual energy bottoming can injure lading, efficient energy absorption by unit 10 reduces the likelihood of injury. Very high energy impacts are infrequent.

Initial movement of piston 46 in the buff direction moves ring 48 over aperture 82 to close the aperture. Likewise, initial draft movement of piston 46 toward head 42 moves the ring 48 over aperture 80. Apertures 80 and 82 are rapidly closed during cushioning of buff and draft impacts and do not flow appreciable amounts of hydraulic fluid from chambers 58 and 60.

During buff collapse of cylinder 22 the interior volume of the cylinder is decreased by the volume of piston rod 50 extended into the cylinder. The decrease in volume increases the gas pressure and increases the static pressure resisting movement of the piston toward rear head 38. The increase in the gas pressure static compression force in buff and corresponding increase in draft are small and are ignored in FIG. 11.

Valves 72 crack open when the pressure of the hydraulic fluid in chamber 58 is increased to 1,585 p.s.i. by a buff impact force. Valves 70 crack open when the pressure of the hydraulic fluid in chamber 60 is increased to 2,026 p.s.i. by a draft impact force. The buff impact force increases the pressure of the fluid in chamber 58 less than the corresponding increase in pressure in chamber 60 from a draft impact force because the area of the piston facing the buff chamber 58 is greater than the area piston facing the draft chamber 60.

The increases in hydraulic fluid pressure required to open valves 70 and 72 are adjusted to control impact accelerations and limit lading damage, dependent upon the weight of the coupled rail cars and the nature of the lading. All valves provide effective hydraulic resistance and energy absorption when fully open. In practice, the buff and draft pressure increases required to open valves 70 and 72 for different weight cars and different ladings may vary from a low of 1,100 p.s.i. in buff to a high of 3,600 p.s.i. in draft.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A rail car cushioning unit comprising a hydraulic cylinder and a yoke assembly; said hydraulic cylinder including front and rear heads, a piston cylinder extending between said heads, an exterior wall outside of the piston cylinder, a piston inside the piston cylinder, said piston engaging the interior of the piston cylinder and movable toward each head from a neutral position between the heads, a piston rod joined to the piston and extending from the piston through an opening in the front head to a free end, a mounting element on the free end of the piston rod, a first cylindrical chamber in the piston cylinder between the piston and the rear head, a second annular chamber in the piston cylinder between the piston and the front head, a third chamber between the piston cylinder and the outer wall, hydraulic fluid in said chambers, a first check valve located adjacent the rear head communicating with the first and third chambers and permitting flow of hydraulic fluid from the third chamber to the first chamber, a second check valve adjacent the front head communicating with the second and third chambers and permitting flow of hydraulic fluid from the third chamber to the second chamber, a first cylinder check valve mounted on the piston cylinder communicating with said first and third chambers and permitting high pressure flow of hydraulic fluid from the first chamber to the third chamber, a second cylinder check valve mounted on the piston cylinder communicating with the second and third chambers and permitting high pressure flow of hydraulic fluid from the second chamber to the third chamber, a first bleed aperture extending through the piston cylinder and located immediately adjacent the side of the piston facing the rear head when the piston is in the neutral position, and a second bleed aperture extending through the piston cylinder and located immediately adjacent the side of the piston facing the front head when the piston is in the neutral position, said bleed apertures opening into said third chamber; and said yoke assembly including a body having a pair of spaced apart straps, front and rear walls extending between said straps, said straps and said walls defining a spring pocket, a drawbar socket in an exterior face of the front wall, end members to either side of the socket, coupler pin bores formed through said end members whereby said body may be connected to the butt end of a coupler drawbar, a mounting member adjacent the rear wall of the body, said piston rod mounting element engageable with said mounting member to join the piston rod to the body, first and second stop plates located in the spring pocket adjacent said walls, said plates each including ends located outwardly of said body, and a spring in said pocket between said stop plates, wherein the piston has a maximum draft stroke from the neutral position of about 2 inches.

2. A rail car cushioning unit as in claim 1 wherein said hydraulic fluid includes hydraulic oil and a pressurized gas.

3. A rail car cushioning unit as in claim 2 wherein said spring includes a stack of elastomer pads extending between said plates.

4. A rail car cushioning unit as in claim 3 wherein said pads are formed from styrene-butadiene rubber and the spring is preloaded and normally exerts a force on the plates.

5. A rail car cushioning unit as in claim 4 wherein the cracking pressure for each of said cylinder check valves is between about 1,100 p.s.i. and about 3,600 p.s.i.

6. A rail car cushioning unit as in claim 4 wherein said first cylinder check valve is located in the cylinder between the piston in the neutral position and the rear head and said second cylinder check valve is located in the cylinder between the piston when in the neutral position and the front head, said cylinder including an additional cylinder check valve located in the cylinder between the piston in the neutral position and the rear head and permitting high pressure flow of hydraulic fluid from the first chamber to the third chamber and an additional cylinder check valve located in the cylinder between the piston in the neutral position and the front head and permitting high pressure flow of hydraulic fluid from the second chamber to the third chamber.

7. A rail car cushioning unit as in claim 6 wherein said piston prevents direct flow of hydraulic fluid between the first and second chambers.

8. A rail car cushioning unit as in claim 6 wherein said first check valve extends through the piston cylinder adjacent the rear head, said cylinder including an additional check valve that extends through the cylinder adjacent the rear head and permitting flow of hydraulic fluid from the third chamber to the first chamber, and wherein said second check valve is located in the front head, said cylinder further including an additional check valve located in the front head and permitting flow of hydraulic fluid from the third chamber to the second chamber.

9. A rail car cushioning unit as in claim 8 wherein said exterior wall is generally cylindrical, extends between said heads and surrounds the piston cylinder and said third chamber is annular.

10. A rail car cushioning unit as in claim 6 wherein said cylinder check valves are spring backed.

11. A rail car cushioning unit as in claim 4 wherein said straps include laterally extending ears, said ears located between said stop plates when said stop plates engage said walls.

12. A rail car cushioning unit as in claim 1 wherein the maximum buff stroke is about 10 inches long.

13. A rail car cushioning unit as in claim 1 wherein the spring normally exerts a force of about 15,000 pounds on the plates.

14. A rail car cushioning hydraulic cylinder including front and rear heads, a piston cylinder extending between said heads, an exterior wall located outside of the piston cylinder, a piston located inside the piston cylinder, said piston engaging the interior of the piston cylinder and movable toward each head from a neutral position between the heads, a piston rod joined to the piston and extending from the piston through an opening in the front head to a free end, a first cylindrical chamber in the piston cylinder between the piston and the rear head, a second annular chamber in the piston cylinder between the piston and the front head, a third chamber between the piston cylinder and the outer wall, pressurized hydraulic fluid in said chambers, a first check valve located adjacent the rear head communicating with the first and third chambers and permitting free flow of hydraulic fluid from the third chamber to the first chamber, a second check valve adjacent the front head communicating with the second and third chambers and permitting free flow of hydraulic fluid from the third chamber to the second chamber, a first cylinder check valve mounted on the piston cylinder communicating with said first and third chambers and permitting high pressure flow of hydraulic fluid from the first chamber to the third chamber, a second cylinder check valve mounted on the piston cylinder communicating with the second and third chambers and permitting high pressure flow of hydraulic fluid from the second chamber to the third chamber, a first aperture extending through the piston cylinder on the side of the piston immediately adjacent the front head when the piston is in the neutral position, and a second aperture extending through the piston cylinder immediately adjacent the side of the piston facing the rear head when the piston is in the neutral position, said apertures opening into said third chamber; wherein the piston has a full draft position spaced about 2 inches from the neutral position of the piston.

15. A rail car cushioning cylinder as in claim 14 wherein the piston has an approximate 10 inch stroke toward the rear head.

16. A rail car cushioning hydraulic cylinder as in claim 14 wherein the impact pressure increase exerted on the end of the piston rod required to crack open each cylinder valve is between about 1,100 p.s.i. and about 3,600 p.s.i.

17. A rail car cushioning unit including a hydraulic cylinder as in claim 14; a rail car coupler; and structure joined to the free end of the piston rod, said structure including a wall facing the coupler and adapted to form a connection between the piston rod and the rail car coupler; a stop member; and an elastomer spring located between the wall on said structure facing toward the coupler and the stop member.

18. A rail car cushioning unit as claimed in claim 17 wherein said structure comprises a yoke having a spring pocket, wherein said stop member comprises a first stop member, said first stop member being located in a portion of said pocket away from the cylinder, said structure further including a second stop member located in the pocket adjacent the cylinder, said elastomer spring being located in said pocket between said first and second stop members.

19. A rail car cushioning unit as in claim 18 wherein said elastomer spring is preloaded.

20. A rail car cushioning unit as in claim 19 wherein said elastomer spring includes a stack of elastomer pads.

21. A rail car cushioning unit as in claim 20 wherein said pads are formed from styrene-butadiene rubber.

22. A rail car cushioning unit as in claim 21 wherein said yoke includes laterally extending ears located between said stop members.

23. A rail car cushioning unit as in claim 14 wherein said cylinder check valves are spring backed.

24. A cushioning unit adapted to be mounted in the sill of a rail car, the unit comprising a hydraulic cylinder and a yoke assembly; said hydraulic cylinder including front and rear heads, a piston cylinder extending between said heads, an exterior wall outside of the piston cylinder, a piston inside the piston cylinder, said piston engaging the interior of the piston cylinder and movable toward each head from a neutral position between the heads, a piston rod joined to the piston and extending from the piston through an opening in the front head to a free end, a first cylindrical chamber in the piston cylinder between the piston and the rear head, a second annular chamber in the piston cylinder between the piston and the front head, a third chamber between the piston cylinder and the exterior wall, pressurized hydraulic fluid in said chambers, a first check valve located adjacent the rear head communicating with the first and third chambers and permitting flow of hydraulic fluid from the third chamber to the first chamber, a second check valve adjacent the front head communicating the second and third chambers and permitting flow of hydraulic fluid from the third chamber to the second chamber, a first cylinder check valve mounted on the piston cylinder communicating said first and third chambers and permitting high pressure flow of hydraulic fluid from the first chamber to the third chamber, a second cylinder check valve mounted on the piston cylinder communicating the second and third chambers and permitting high pressure flow of hydraulic fluid from the second chamber to the third chamber; and said yoke assembly including a body having a spring pocket, a drawbar socket on one side of the spring pocket, end members on one end of the socket, coupler pin bores formed through said end members whereby said body may be connected to the butt end of a coupler drawbar, a piston rod mounting member on the other end of the pocket, said piston rod mounting member engageable with said piston rod free end to join the piston rod to the body, first and second stop plates located in the spring pocket, said plates each including plate ends located outwardly of said body in position to engage stops on a rail car sill, and an elastomer spring in said pocket between said stop plates, said pressurized hydraulic fluid exerting a force on the piston holding the stop plate adjacent said one side of the spring pocket against a stop member on a rail car sill when the piston is in the neutral position; and bleed apertures formed through the piston cylinder to either side of the piston when in the neutral position.

25. A rail car cushioning unit as in claim 24 including bleed apertures formed through the piston cylinder to either side of the piston when in the neutral position.

26. A railcar shock absorber, comprising in combination:

a cylinder which has a buff end and a draft end and containing a liquid and gas fluid under gas pressure for absorbing shock due to buff and draft movement;

a piston carried in the cylinder;

a piston shaft extending from the piston sealingly through the draft end of the cylinder, the gas pressure urging the piston toward the draft end of the cylinder while restoring from a buff shock;

one of the piston shaft and the cylinder adapted to be secured stationarily to a frame of the railcar and the other of the piston shaft and the cylinder adapted to be secured to a coupling for coupling to adjacent railcars; and a spring for stopping further restoring movement of the piston toward the draft end of the cylinder at a selected neutral position spaced from the draft end of the cylinder, and for allowing the piston to move from the neutral position toward the draft end of the cylinder if a draft shock occurs of sufficient magnitude while the piston is in the neutral position;

wherein the piston has a maximum draft stroke from the neutral position to a full draft position, the maximum draft stroke from the neutral position being 2 inches, the spring allowing for more than one inch of compression in response to a draft shock of sufficient magnitude; and wherein the piston has a maximum buff stroke from the neutral position to a full buff position, the buff stroke from the neutral position being more than 9 inches.

27. A method for absorbing buff and draft shock in a railcar, comprising:

(a) mounting to the railcar a cylinder which has a buff end and a draft end, a piston carried in the cylinder, a piston shaft extending from the piston sealingly through the draft end of the cylinder, and a spring substantially aligned with the piston;

(b) placing in the cylinder a liquid and gas fluid under gas pressure;

(c) securing one of the piston shaft and the cylinder stationarily to a frame of the railcar and the other of the piston shaft and the cylinder to a coupling for coupling to adjacent railcars;

(d) while free of buff and draft shock, restoring the piston toward the draft end of the cylinder due to the gas pressure;

(e) applying an axial force through the spring to stop further restoring movement of the piston toward the draft end of the cylinder at a selected neutral position spaced from the draft end of the cylinder;

(f) allowing the piston to move from the neutral position toward the draft end of the cylinder if a draft shock occurs of sufficient magnitude while the piston is in the neutral position, the piston having a full draft position spaced a maximum of 2 inches from the neutral position of the piston, the full draft position being at one end of the draft stroke of the piston; and (g) allowing the piston to move from the neutral position toward the buff end of the cylinder if a buff shock occurs of sufficient magnitude while the piston is in the neutral position, the piston having a full buff position spaced at least 9 inches from the neutral position of the piston, the full buff position being at one end of the buff stroke of the piston.

28. A railcar cushioning device for cushioning both buff and draft impacts, the cushioning device comprising:

a cylinder having a first head at one cylinder end, a second head at an opposed cylinder end, the cylinder heads defining a piston cylinder extending between said heads, the cylinder further including an exterior wall outside of the piston cylinder;

the cylinder having a first chamber in the piston cylinder between the piston and the first head, a second chamber between the piston and the second head, and a third chamber between the piston cylinder and the exterior wall;

a piston located in the piston cylinder and movable toward the first head and the second head from a neutral position between the heads;

a piston rod joined to the piston and extending from the piston through the first head to a free end;

pressurized fluid in at least the second chamber;

a fluid flow path between the third chamber and the first chamber and a fluid flow path between the third chamber and the second chamber;

a spring limiting movement of the piston toward the first head, the spring allowing the piston to move from the neutral position toward the first head of the cylinder if a draft shock occurs of sufficient magnitude while the piston is in the neutral position;

the pressurized fluid and the spring normally holding the piston in the neutral position, the neutral position of the piston being spaced between the first and second heads;

the piston having a draft stroke extending from the neutral position a distance to a full draft position in response to a draft force of sufficient magnitude, the full draft position being at one end of the draft stroke of the piston;

the neutral position of the piston being spaced more than 1 inch from the full draft position of the piston, the neutral position of the piston being spaced a maximum of 2 inches from the full draft position of the piston;

the piston having a buff stroke extending from the neutral position a distance to a full buff position in response to a buff force of sufficient magnitude, the full buff position being at one end of the buff stroke of the piston;

the neutral position of the piston being spaced more than 9 inches from the full buff position of the piston.

* * * * *

UNITED STATES PATENT AND TRADEMARK OFFICE

CERTIFICATE OF CORRECTION

PATENT NO. : 6,357,612 B1 
DATED : March 19, 2002
INVENTOR(S) : Jay P. Monaco, Julius I. Pershwitz and Mark P. Scott It is certified that error appears in the above-identified patent and that said Letters Patent is hereby corrected as shown below:

Title page,
Item [75], Inventor's name, "Julius I. Perchets," is misspelled, correct spelling
-- Julius I. Pershwitz --

Signed and Sealed this

Twenty-sixth Day of November, 2002

*Attest:*

*Attesting Officer*

JAMES E. ROGAN
*Director of the United States Patent and Trademark Office*